US006817586B1

(12) United States Patent
Lin

(10) Patent No.: US 6,817,586 B1
(45) Date of Patent: Nov. 16, 2004

(54) PAPER PALLET

(76) Inventor: Ching-Chiang Lin, Room 3, 3 Fl., No. 43, Sec. 1, Mei Tsuen Rd., Taichung (TW)

( * ) Notice: Subject to any disclaimer, the term of this patent is extended or adjusted under 35 U.S.C. 154(b) by 0 days.

(21) Appl. No.: 10/637,878

(22) Filed: Aug. 8, 2003

(51) Int. Cl.[7] ..... A47B 91/00
(52) U.S. Cl. ..... 248/346.02
(58) Field of Search ..... 246/346.01, 346.02; 108/51.11; 52/783.11, 793.11

(56) References Cited

U.S. PATENT DOCUMENTS 3,907,241 A * 9/1975 Oglesby et al. ..... 248/346.4
4,241,892 A * 12/1980 Morris ..... 248/346.02
4,931,340 A * 6/1990 Baba et al. ..... 428/73
5,445,861 A * 8/1995 Newton et al. ..... 428/116
5,493,962 A * 2/1996 McCarthy ..... 108/51.3
6,126,124 A * 10/2000 Wagner ..... 248/127
6,187,401 B1 * 2/2001 Heisel et al. ..... 428/36.9

* cited by examiner

*Primary Examiner*—Ramon O. Ramirez
*Assistant Examiner*—Kofi Schulterbrandt
(74) *Attorney, Agent, or Firm*—Alan D. Kamrath; Nikolai & Mersereau, P.A.

(57) ABSTRACT

A pallet has a supporting board, multiple supporters, multiple reinforcing rings and a base. The supporting board is rectangular and is made of paper. The supporting board has a top, a bottom, four sides, an inner space and a honeycomb-like baffle. The honeycomb-like baffle is received in the inner space and is formed between the top and the bottom. The supporters are made of paper and are securely attached to the bottom of the supporting board. The reinforcing rings are made of paper, and securely mounted respectively around the supporters and abut against the bottom of the supporting board. The base is made of paper and is securely attached to the bottoms of the supporters. Accordingly, the pallet is light and is convenient to assemble and to transport.

6 Claims, 4 Drawing Sheets

PAPER PALLET

BACKGROUND OF THE INVENTION

1. Field of the Invention

The present invention relates to a pallet, and more particularly to a pallet made of paper and having a simplified structure.

2. Description of Related Art

Pallets are used to support cargoes or packs for conveniently transporting the cargoes and the packs. The conventional pallets are made of wood and are composed of multiple planks longitudinally and laterally combined together with fasteners, such as nails. However, the conventional wooden pallet is easily broken and damaged by bugs or moisture after a term of use, and the useful life of the conventional wooden pallet is short. In addition, the exposed fasteners easily hurt one who touches the conventional wood pallet.

In another prior art, another conventional pallet is made of metal, such as steel. The conventional metal pallet is not easily damaged, but is very heavy so transporting the metal pallet with cargoes or packs is very inconvenient. Furthermore, the pallets are stacked to save space for storing the cargoes and packs. However, it is inconvenient to stack the conventional metal pallets, and the heavy metal pallets easily damage the cargoes and packs disposed on the metal pallets. In addition, conventional pallets made of wood or metal are expensive.

To overcome the shortcomings, the present invention tends to provide a paper pallet to mitigate or obviate the aforementioned problems.

SUMMARY OF THE INVENTION

The main objective of the invention is to provide a pallet made of paper that is light and convenient to assemble and to transport. The pallet has a supporting board, multiple supporters, multiple reinforcing rings and a base. The supporting board is rectangular and is made of paper. The supporting board has a top, a bottom, four sides, an inner space and a honeycomb-like baffle. The honeycomb-like baffle is received in the inner space and is formed between the top and the bottom. The supporters are made of paper and are securely attached to the bottom of the supporting board. The reinforcing rings are made of paper, are securely mounted respectively around the supporters and abut against the bottom of the supporting board. The base is made of paper and is securely attached to the bottoms of the supporters.

Other objectives, advantages and novel features of the invention will become more apparent from the following detailed description when taken in conjunction with the accompanying drawings.

DETAILED DESCRIPTION OF PREFERRED EMBODIMENT

Figure 1:
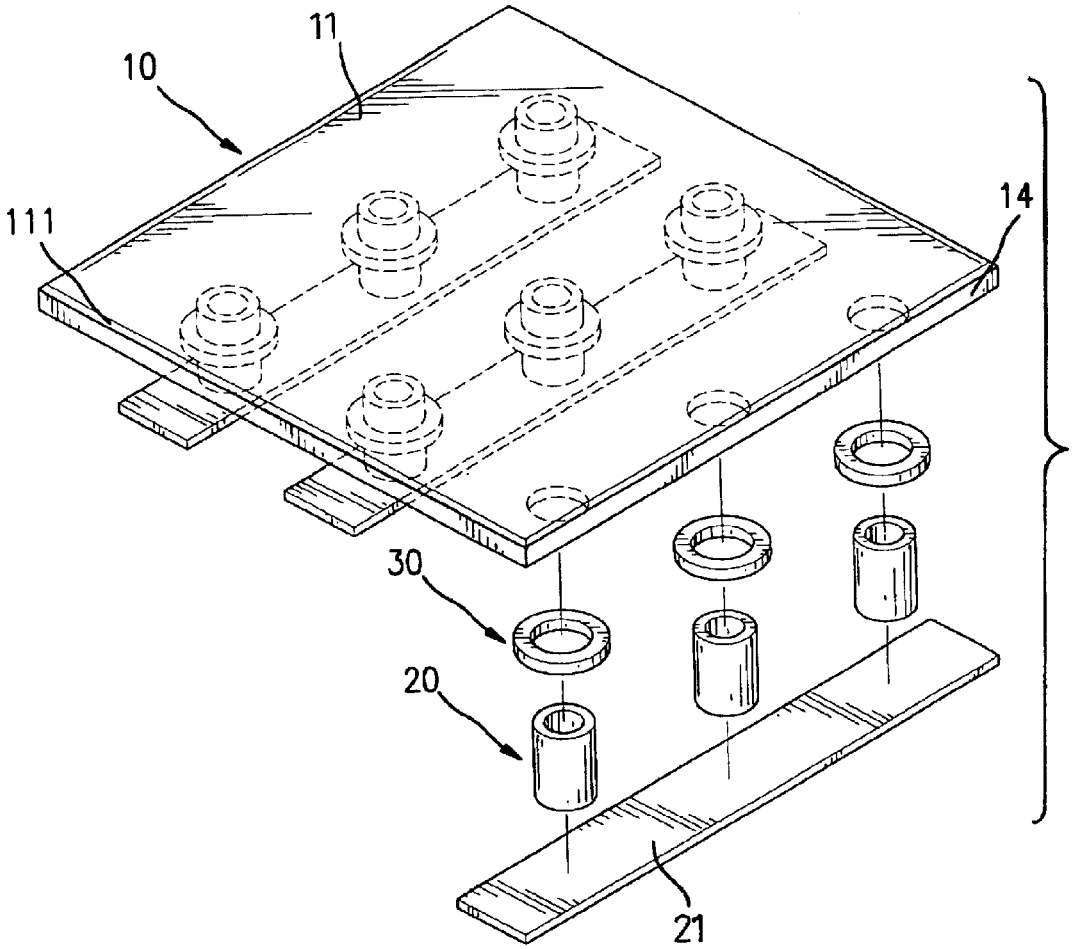
FIG. 1 is an exploded perspective view of a pallet in accordance with the present invention.
Figure 2:
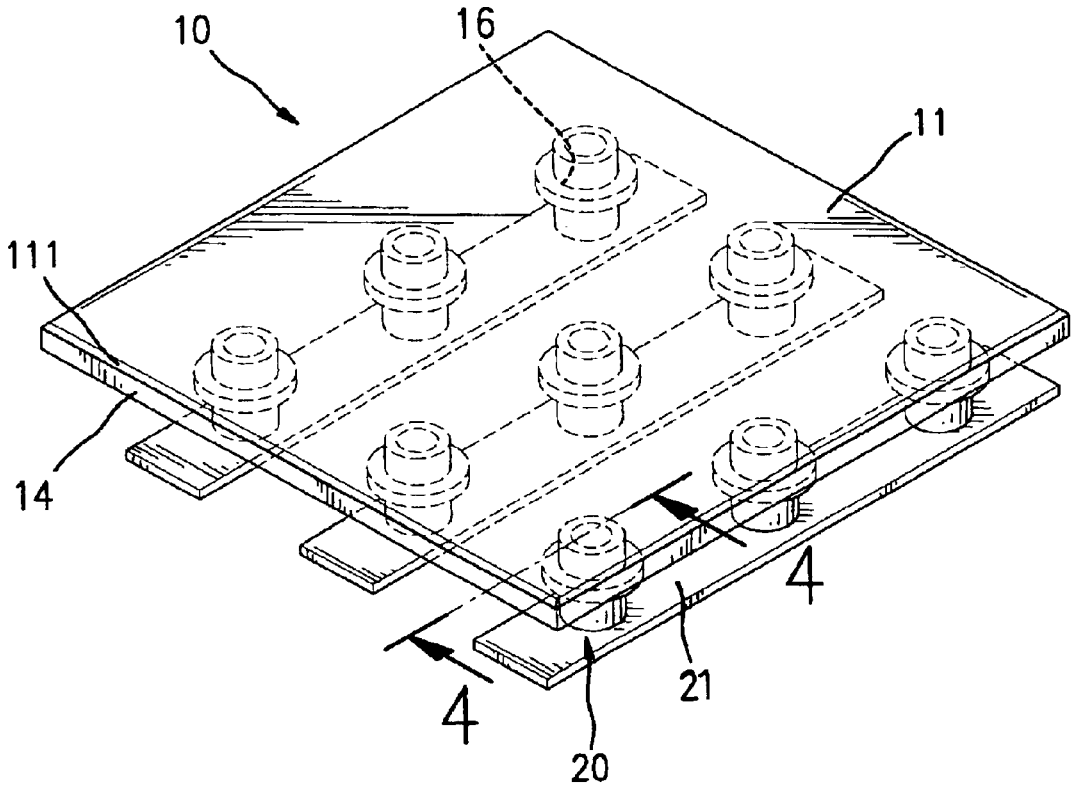
FIG. 2 is a perspective view of the pallet in FIG. 1.
Figure 3:
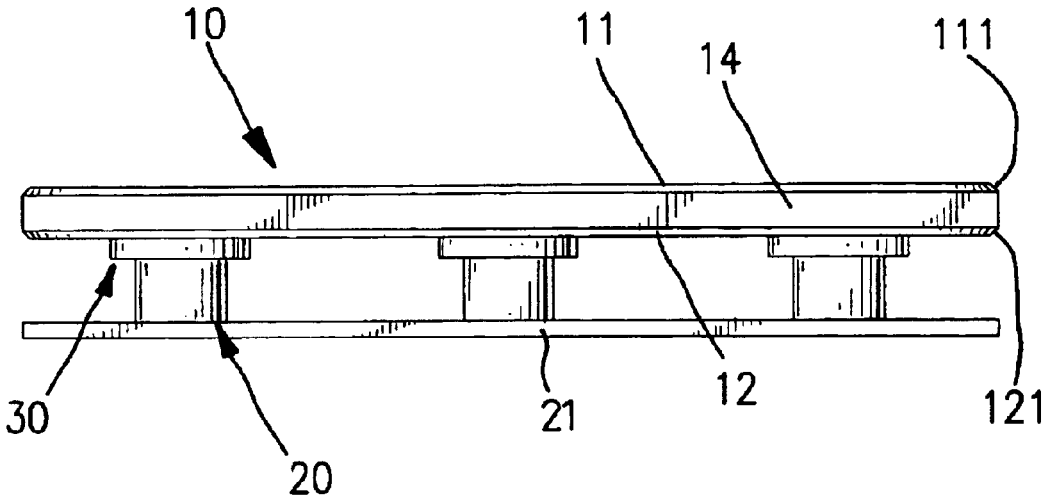
FIG. 3 is a side plan view of the pallet in FIG. 1.
Figure 4:
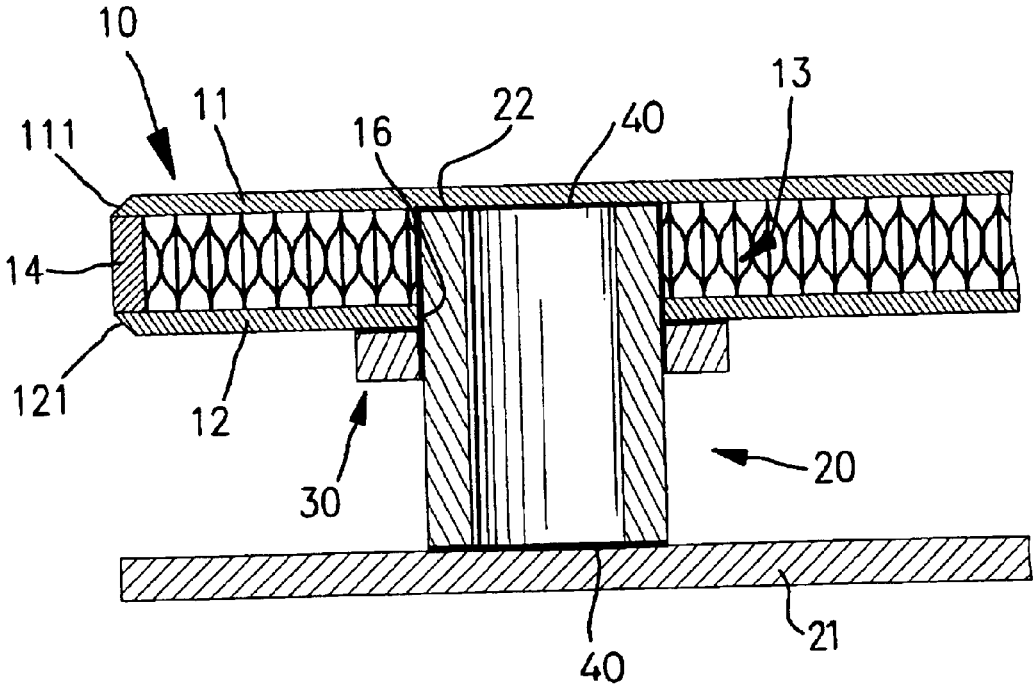
FIG. 4 is an enlarged cross sectional side plan view of the pallet along a 4—4 line in FIG. 2.

With reference to FIGS. 1 to 4, a pallet in accordance with the present invention comprises a supporting board (10), multiple supporters (20), multiple reinforcing rings (30) and a base (not numbered). The supporting board (10) is rectangular and is made of paper. The supporting board (10) has a top (11) with an outer edge, a bottom (12) with an outer edge, four sides (14), an inner space (not numbered), a honeycomb-like baffle (13) and multiple holes (16). The inner space is defined between the top (11), the bottom (12) and the sides (14). The top (11) and the bottom (12) have a first thickness, and the sides (14) have a second thickness. In practice, the thickness of the sides (14) is larger than that of the top (11) and the bottom (12). With the thick sides (14), the deformation of the supporting board (10) is prevented when the laden supporting board (10) is bound with a rope. In addition, a cutout (111,121) is formed around each respective outer edge of the top (11) and the bottom (12). With the arrangement of the cutouts (111,121), damage to the outer edges of the top (11) and the bottom (12) can be prevented when cargoes and packs are loaded/offloaded.

The honeycomb-like baffle (13) is received in the inner space and is formed between the top (11) and the bottom (12), and the honeycomb-like baffle (13) can enhance the structural strength of the supporting board (10). The holes (16) are defined in the bottom (12) and communicate with the inner space.

The supporters (20) are made of paper and are securely attached to the bottom (12) of the supporting board (10). In a preferred embodiment, nine supporters (20) are attached to the supporting board (10). Each respective supporter (20) is cylindrical and has a bottom (not numbered) and a top (22). The top (22) of each supporter (20) extends through one of the holes (16) in the bottom (12) of the supporting board (10) and is securely received in the inner space. In practice, a layer of glue (40) is applied to the top (22) of each supporter (20), and the top (22) of the supporter (20) can securely combine with the top (11), the honeycomb-like baffle (13) and the inner surface of the corresponding through hole (16) of the supporting board (10).

The reinforcing rings (30) are made of paper and are securely mounted respectively around the supporters (20) with a layer of glue (40). The reinforcing rings (30) abut against the bottom (12) of the supporting board (00), and a layer of glue (40) is applied between the bottom (12) of the supporting board (10) and 0.9 each respective reinforcing ring (30).

The base is made of paper and is securely attached to the bottoms of the supporters (20) with glue (40). In practice, the base comprises multiple base straps (21). Each base strap (21) is attached to at least one of the multiple supporters (20). In the embodiment illustrated in the drawings, the base comprises three base straps (21), and three supporters (20) are attached to each respective base strap (21).

In such a pallet, the weight of the pallet is low because all of the elements of the pallet are made of paper, such that transporting or stacking the pallet is convenient. The cargoes and packs put on the stacked paper pallet will not be damaged even when overstacked. In addition, the pallet in accordance with the present invention can be made of recycled paper. Thus, the cost for manufacturing the pallet is low, and the pallet is friendly to the environment.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pallet comprising:

a rectangular supporting board with a top, a bottom and four sides made of paper and having:

an inner space defined between the top, the bottom and the sides;

a honeycomb shaped baffle received in the inner space and formed between the top and the bottom; and multiple holes defined in the bottom and communicating with the inner space;

multiple supporters made of paper and securely attached to the bottom of the supporting board, and each supporter having a bottom and a top, with each supporter extending through one of the holes in the bottom of the supporting board and securely received in the inner space;

multiple reinforcing rings made of paper, securely mounted respectively around the supporters and abutting against the bottom of the supporting board; and a base made of paper and securely attached to the bottoms of the supporters.

2. The pallet as claimed in claim 1, wherein each respective supporter is cylindrical.

3. The pallet as claimed in claim 1, wherein the top and the bottom of the supporting board have a thickness; and each side of the supporting board has a thickness larger than that of the top and the bottom of the supporting board.

4. The pallet as claimed in claim 1, wherein the top of the supporting board has an outer edge and a cutout formed around the outer edge.

5. The pallet as claimed in claim 1, wherein the bottom of the supporting board has an outer edge and a cutout formed around the outer edge.

6. The pallet as claimed in claim 1, wherein the base comprises multiple base straps and each of the multiple base straps is attached to at least one of the multiple supporters.

* * * * *